US005983401A

United States Patent [19]

Ohara

[11] Patent Number: 5,983,401

[45] Date of Patent: Nov. 16, 1999

[54] TROUSERS AND COMBINATION WEAR OPENABLE ALONG ROOT PORTION STARTING FROM BACK UPPER POINT OF WAIST

[75] Inventor: Gen Ohara, Chofu, Japan

[73] Assignee: Kabushiki Kaisha Forward, Tokyo, Japan

[21] Appl. No.: 08/989,913

[22] Filed: Dec. 12, 1997

[30] Foreign Application Priority Data

Dec. 20, 1996 [JP] Japan ..... 8-355213
Nov. 5, 1997 [JP] Japan ..... 9-319046

[51] Int. Cl.[6] ..... A41D 1/06

[52] U.S. Cl. ..... 2/227; 2/234

[58] Field of Search ..... 2/227, 234, 405, 2/408, 78.2, 79

[56] References Cited

U.S. PATENT DOCUMENTS

| | | |
|---|---|---|
| Re. 33,966 | 6/1992 | Robison . |
| 1,175,514 | 3/1916 | Fox . |
| 1,179,159 | 4/1916 | Buley . |
| 1,485,793 | 3/1924 | McKee . |
| 1,629,687 | 5/1927 | Duffner . |
| 2,093,903 | 9/1937 | Bernstein . |
| 2,277,068 | 3/1942 | Bulloch . |
| 2,312,025 | 2/1943 | Butler . |
| 2,468,346 | 4/1949 | Rayden . |
| 2,477,593 | 8/1949 | Gershenow . |
| 2,552,875 | 5/1951 | Stein . |
| 2,703,404 | 3/1955 | Lawson . |
| 3,041,625 | 7/1962 | Joseph . |
| 3,088,116 | 5/1963 | Simonoff . |
| 3,425,063 | 2/1969 | Brown . |
| 4,446,575 | 5/1984 | Davis . |
| 4,554,684 | 11/1985 | Cadoret . |
| 4,578,828 | 4/1986 | Smith et al. . |
| 4,628,545 | 12/1986 | Metzler . |
| 5,010,595 | 4/1991 | Stradley . |
| 5,033,126 | 7/1991 | Wruck et al. . |
| 5,163,182 | 11/1992 | Fiveash . |
| 5,241,708 | 9/1993 | Rodarmel . |
| 5,473,780 | 12/1995 | Zen . |
| 5,511,246 | 4/1996 | Farkas et al. . |
| 5,586,339 | 12/1996 | Lathan . |
| 5,625,898 | 5/1997 | Telega . |
| 5,790,984 | 8/1998 | Doubleday . |
| 5,802,611 | 9/1998 | McKenzie et al. . |

FOREIGN PATENT DOCUMENTS

| | | |
|---|---|---|
| 8-324719 | 12/1996 | Japan . |

*Primary Examiner*—John J. Calvert
*Assistant Examiner*—Shirra L. Jenkins
*Attorney, Agent, or Firm*—Oliff & Berridge, PLC

[57] ABSTRACT

Trousers or a combination wear composed of an upper wear portion and a trouser portion, wherein the trousers or the trouser portion of the combination wear is openable at a root portion thereof by a slide fastener along a U-shaped center line thereof starting from a back upper edge of the trousers or a corresponding back center point positioned between the trouser portion and the upper wear portion towards a front upper portion of the trousers or a corresponding front center point positioned between the trouser portion and the upper wear portion through a lowest point of the U-shaped center line. Further, the slide fastener may be a double slide fastener openable from both ends so that the root portion is also openable starting from the front upper portion of the trousers or the front center point positioned between the trouser portion and the upper wear portion.

15 Claims, 14 Drawing Sheets

TROUSERS AND COMBINATION WEAR OPENABLE ALONG ROOT PORTION STARTING FROM BACK UPPER POINT OF WAIST

BACKGROUND OF THE INVENTION

1. Field of the Invention

The present invention relates to trousers and a combination wear, and more particularly, to trousers and a combination wear openable along a root portion thereof by a slide fastener.

2. Description of the Prior Art

Trousers and combination wears openable along a root portion thereof are old, well known and widely used.

The conventional trousers and combination wears are generally openable at a root portion only in a waist front area thereof, as normally closed by a plurality of buttons since old days but now mostly by a slide fastener according to the wide spread thereof. The conventional opening of the trousers or the combination wears at the waist front area provides the wearers a convenience for putting on and off the trousers or the combination wears as well as a convenience for making water for male wearers.

However, the opening in the waist front area in the conventional trousers or combination wears terminates at a point still substantially on the front side of the lowest point of a U-shaped center line of the root portion of the trousers or the trouser portion of the combination, such that the opening is often insufficient for an easy making of water for male wearers, and further, in the case of the combination wears, the opening in the waist front area of the trouser portion is quite useless for female wearers to make water. In view of these, in Japanese Patent Application Heisei 8-324719, the present inventor proposed trousers and a combination wear openable along the U-shaped center line of the root portion thereof starting from a front upper end of the trousers or a corresponding point between an upper wear portion and a lower trouser portion of the combination wear till at least the lowest point of the U-shaped center line, more desirably, till a back upper point of the waist of the wearer beyond the lowest point thereof.

Since then, the present inventor has further tested a lot of trousers and combination wears openable by a slide fastener in a wide variety of manners along the U-shaped center line, and as a result, found that it provides a highest convenience for female wearers and generally for male wearers that the root portion of the trousers or the combination wear is opened starting from a back upper point of the waist toward a front upper point of the waist of the wearer through the bottom portion thereof, contrary to the conventional concept that the root portion of he trousers or the trouser portion of the combination wears is opened in the front portion of the waist of the wearer starting from the front upper point thereof.

SUMMARY OF THE INVENTION

In view of such an observation that the trousers or combination wears are more convenient for female wearers and generally also for male wears when the root portion thereof is opened along the U-shaped center line starting from a back upper point of the waist of the wearer toward a front upper portion of the waist of the wearer through a lowest point thereof, and in view of an observation that the so oriented opening of the root portion of the trousers or the trouser portion of the combination wears along the U-shaped center line thereof is easily available by a slide fastener such that an opener thereof is clamped by the tips of fingers of the wearer by oneself, it is a primary object of the present invention to provide trousers and a combination wear improved for a greater convenience of the wearer.

According to the present invention, the above-mentioned object is accomplished by trousers openable at a root portion thereof along a U-shaped center line thereof by a slide fastener starting from a first end thereof positioned around a back upper edge thereof till a second end thereof positioned around a front upper edge thereof through a lowest point of the U-shaped center line, or a combination wear including an upper wear portion and a trouser portion integral with one another, the trouser portion being openable at a root portion thereof along a U-shaped center line thereof by a slide fastener starting from a first end thereof positioned around a back upper edge thereof till a second end thereof positioned around a front upper edge thereof through a lowest point of the U-shaped center line.

When one wears trousers or a combination wear of the above-mentioned construction, he or she can easily open the root portion of the trousers or the trouser portion of the combination wear continuously along the U-shaped center line defining the root portion by opening the slide fastener starting from said first end positioned around a back upper point of his or her waist toward said second end positioned around a front upper point of his or her waist through the bottom portion of his or her root portion to any desired extent of opening for the convenience of putting on and off the trousers or the combination wear as well as making water or relieving nature, regardless of the wear's sex.

Further, in the trousers or the combination wear of the above-mentioned construction, said slide fastener may be a double slide fastener openable from both of said first and second ends by a first and a second opener, respectively, such that when said second opener is positioned at said second end, the root portion is openable along the U-shaped center line starting from said first end toward said second end through the lowest point of the U-shaped center line by said first opener, while when said first opener is positioned at said first end, the root portion is openable along the U-shaped center line starting from said second end toward said first end through the lowest point of the U-shaped center line by said second opener.

According to such a construction, in addition to the availability of opening the trousers or the trouser portion of the combination wear at the root portion along the U-shaped center line starting from said first end positioned around the back upper point of the waist of the wearer toward said second end positioned around the front upper point of the waist of the wearer to any desired extent, a male wearer can open the front portion of the trousers or the trouser portion of the combination wear for any desired amount starting from said second end of the slide fastener positioned around the front upper point of his waist along the U-shaped center line for making water.

Further, the trousers or the combination wear of the above-mentioned construction may be modified such that an upper edge portion of the trousers or the trouser portion is defined by a belt portion, said first end of the slide fastener being positioned adjacent to a lower edge of the belt portion, with a cloth material forming the trousers or the combination wear defining a pair of free upper edge portions extending along the lower edge of the belt portion on opposite sides of said first end of the slide fastener, such that the trousers or the trouser portion of the combination wear is widely openable at the back upper edge thereof with the free upper edge portions being released from one another by the slide fastener being opened at least at and in an area adjacent to said first end thereof.

Further, said pair of free upper edge portions of the cloth material may be formed by the cloth material being transversely cut to form a pair of slits on opposite sides of said first end of the slide fastener along the lower edge of the belt portion.

Further, such a construction may further incorporate a guide rail means arranged to extend along the belt portion in an area above said first end of the slide fastener and a plurality of slide elements supported by the guide rail means to be slidable therealong, wherein the free upper edge portions are each connected with each half of the plurality of slide elements such that the free upper edge portions are each separately supported by the guide rail means to be movable therealong in opposite directions.

The guide rail means may incorporate therein a hinge means at a transversely central portion thereof so as to be foldable therealong.

The guide rail means may comprise a pair of U-shaped wire elements connected with one another at an open end of the U-shape thereof by the hinge means to be foldable therealong, the U-shaped wire elements each slidably supporting each half of the plurality of slide elements at one of leg portions thereof, while being fastened to the cloth material at another of the leg portions.

The belt portion may have an overlapped portion around a back central portion thereof corresponding to the back upper edge of the trousers or the trouser portion of the combination wear where opposite ends of the belt portion are laid one over the other and normally fastened by a releasable fastening means.

A piece of cloth may be provided along the belt portion as connected to one of said opposite ends of the belt portion laid inside of the other of said overlapped opposite ends to be patched on to the cloth material forming the trousers or the combination wear from an inside thereof to lie behind the free upper edge portions.

A pair of openable portions may be provided at opposite side portions of the trousers or at opposite side chest and waist portions of the combination wear when it is designed as a sleeveless combination wear, each such side openable portions being openable by a slide fastener starting from a side upper edge thereof.

When the upper wear portion of the combination wear is of the type having a pair of sleeve portions and openable along a front vertical center line thereof, the combination wear may be designed such that the trouser portion is openable till a front upper edge thereof, and the combination wear is continuously openable starting from a back point positioned between the upper wear portion and the trouser portion till a front upper edge of the upper wear portion through the lowest point of the U-shaped center line.

BRIEF DESCRIPTION OF THE DRAWINGS

In the accompanying drawings.

DESCRIPTION OF THE PREFERRED EMBODIMENTS

In the following, the present invention will be described in more detail with respect to some preferred embodiments thereof with reference to the accompanying drawings.

Figure 1:
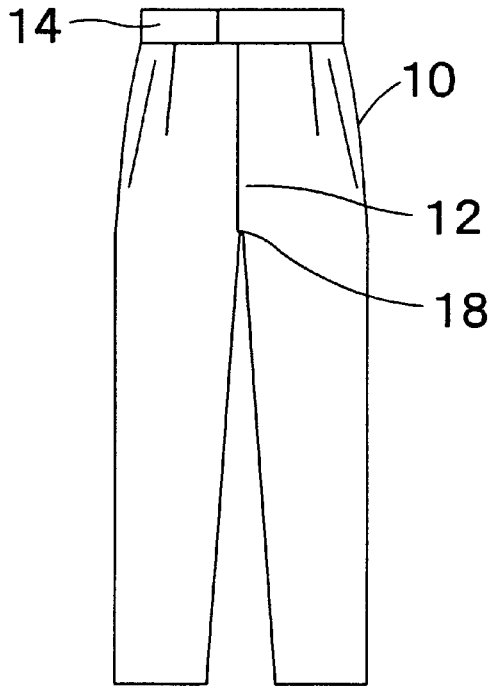
FIG. 1 is a front view showing an embodiment of the trousers according to the present invention.

As shown in FIG. 1 in the front view in the form of an embodiment, the trousers according to the present invention are almost the same as a conventional pair of trousers of an ordinary design in the front outside view. However, as will be understood from FIGS. 2–5 showing various details of the trousers of FIG. 1, the trousers generally indicated by reference numeral 10 incorporate a slide fastener 12 adapted to open the root portion thereof along a U-shaped center line thereof starting from a beginning point 16 positioned close to a back upper edge of a belt portion 14 fringing an upper edge of the trousers till an ending point 20 positioned just below the belt portion 14 in the front thereof through a lowest point 18 of the U-shaped center line in continuation therealong. 22 designates an opener of the slide fastener 12.

Figure 5:
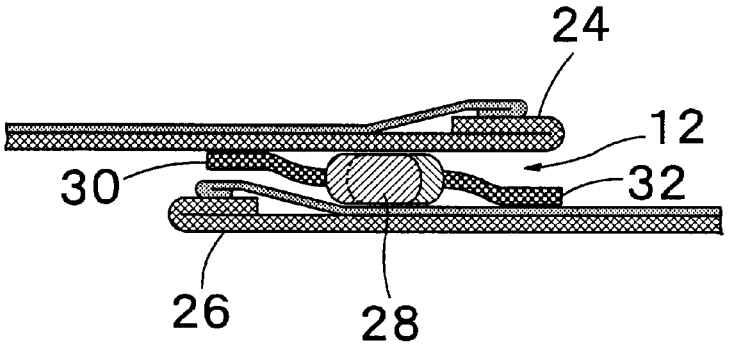
FIG. 5 is an enlarged sectional view along line V—V in FIG. 2.
Figure 2:
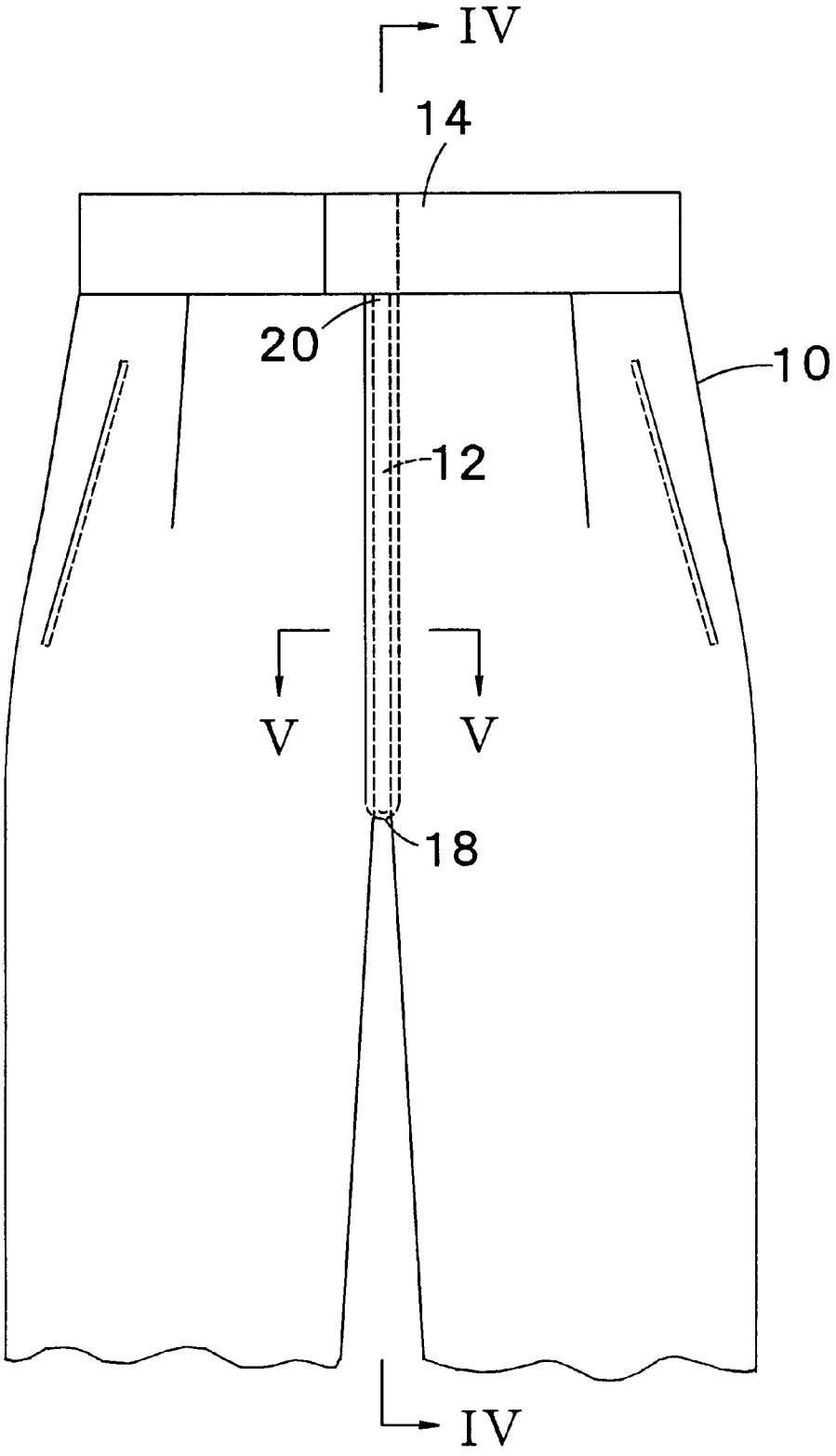
FIG. 2 is a front view showing an upper half portion of the trousers shown in FIG. 1 in an enlarged scale for more details.

As shown in FIG. 5, the construction for mounting the slide fastener 12 along a root opening portion of the trousers is itself the same as the conventional construction thereof. In other words, the root opening portion of the trousers is defined by an inner edge portion 24 and an outer edge portion 26 laid one over the other so that the slide fastener 12 of an ordinary construction having alternately meshing teeth 28 is disposed between the overlapping inside and outside edge portions with one strip piece 30 thereof sewed on to the inside edge portion 24 therealong and with another strip piece 32 thereof sewed on to the outside edge portion 26 therealong.

Thus, when the opener 22 is clamped by the tips of fingers and moved from the beginning point 16 toward the ending point 20, the root portion of the trousers is widely opened starting from the back upper edge thereof toward the front upper edge thereof through the bottom of the root portion for any desired opening extent. Although it is required for opening the root portion of the trousers that the wearer turns his or her one arm to his or her back for clamping the opener 22 positioned at the beginning point 16 arranged at a back upper position of his or her waist, the action required is only to clamp the opener of the slide fastener and to move it along the U-shaped center line defining the root portion of the trousers from back toward front. Of course, the opener may be once, twice or more times removed from the tips of fingers at any point in the way to change the posture of the arm. By the starting point for opening the root portion of the trousers by the slide fastener being positioned at the rear upper edge of the trousers, a female wearer can easily open the root portion of the trousers as much as she desires for washing hands, regardless of the kinds thereof, without removing the trousers from her waist. A male wearer can also easily open the root portion of the trousers starting from the back upper edge thereof as much as he desires for relieving nature, with no need of removing the trousers from his waist, and further, although it can not be said to be only a necessary portion, the root portion of the trousers can be opened enough for the convenience of making water by so shifting the opener into the front portion of the waist.

Figure 3:
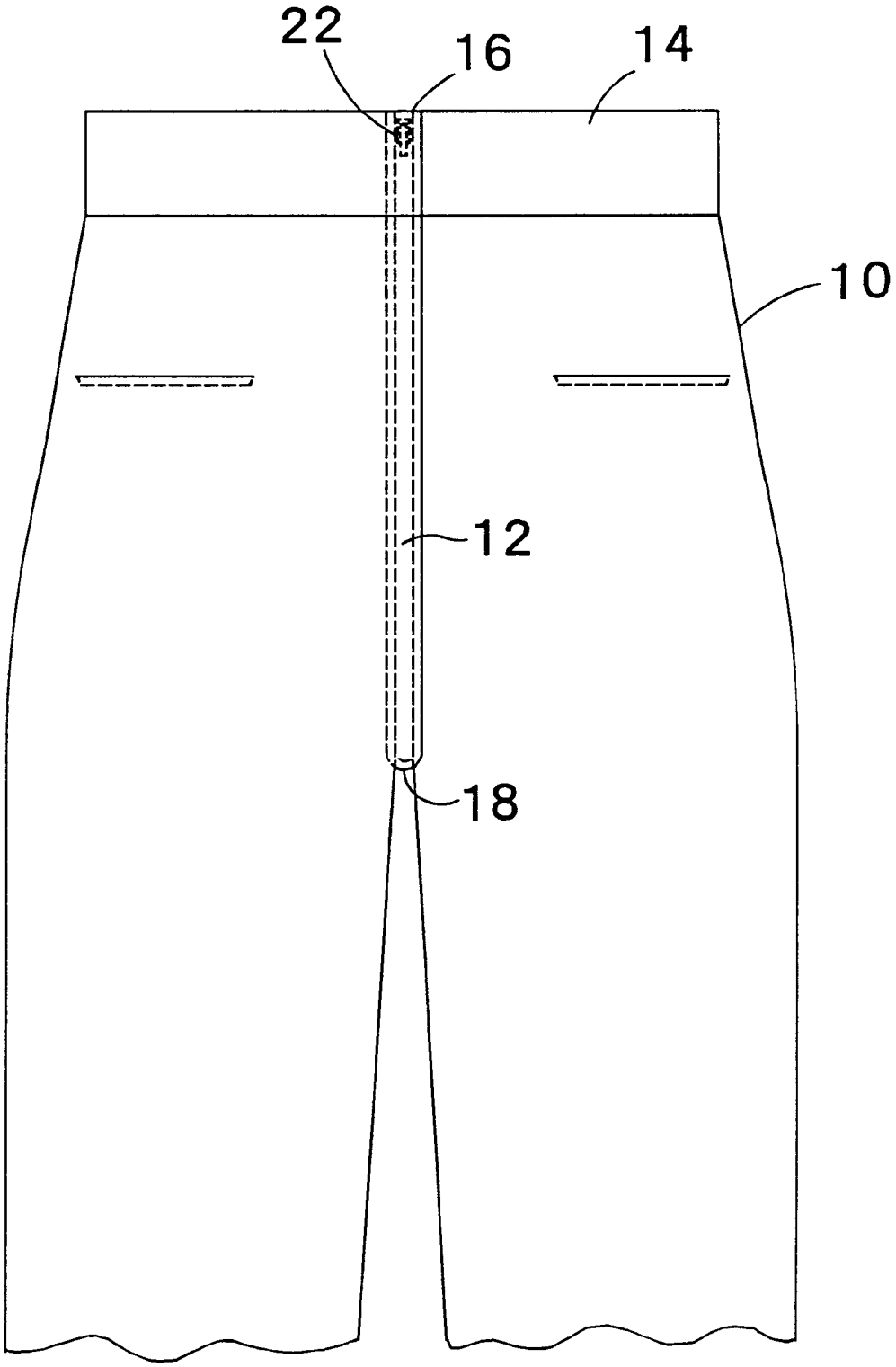
FIG. 3 is a rear view of the upper half portion of the trousers shown in FIG. 2.
Figure 6:
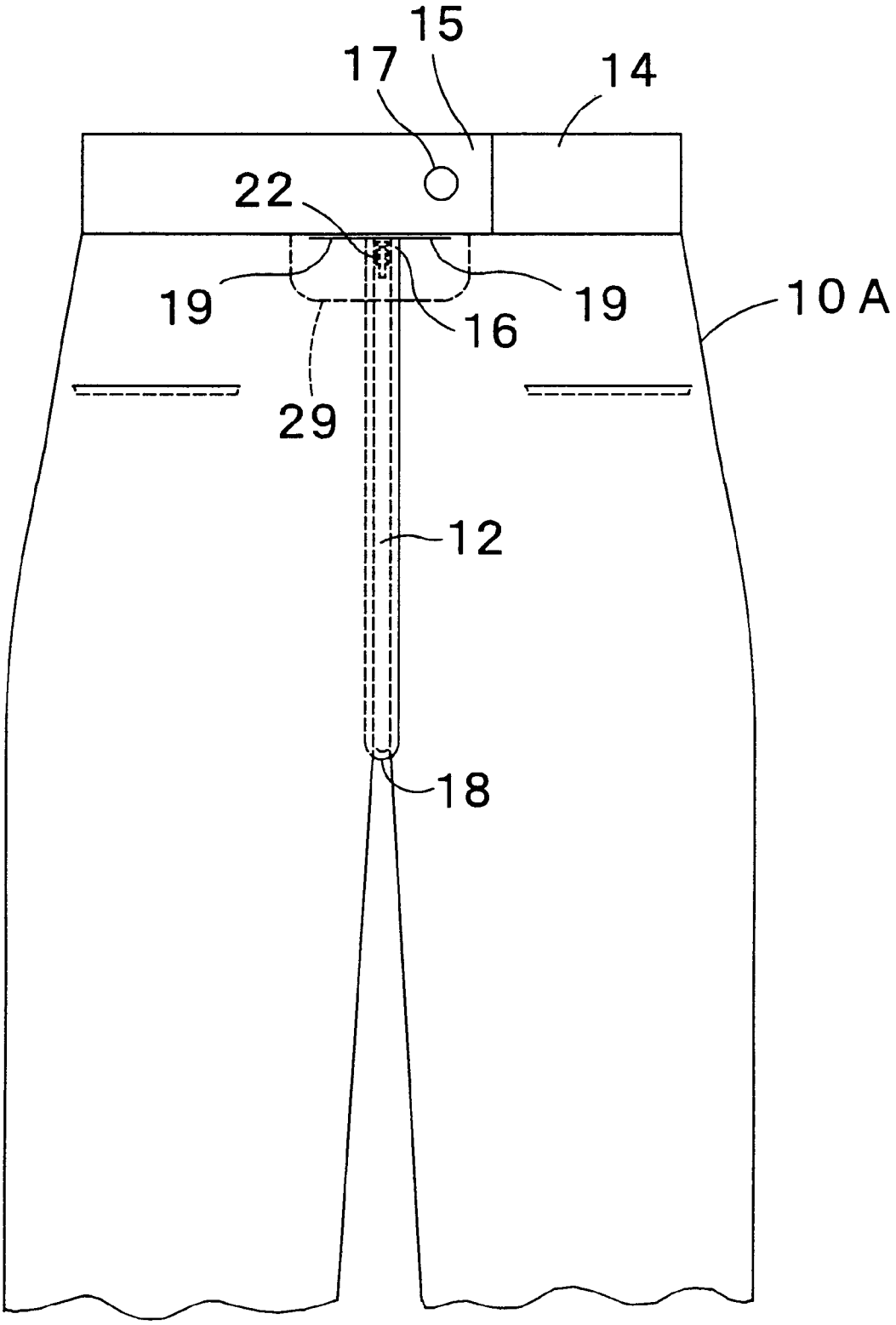
FIG. 6 is a rear view of an upper half portion of another embodiment of the trousers according to the present invention.

FIG. 6 is a rear view similar to FIG. 3, showing an upper half portion of another embodiment of the trousers according to the present invention, partly modified from the embodiment shown in FIGS. 1–5. In FIG. 6, the portions corresponding to those shown in FIG. 3 are designated by the same reference numerals as in FIG. 3. In the trousers 10A of this embodiment, the slide fastener 12 is provided to extend downward from a lower edge of the belt portion 14, while the belt portion 14 is designed to be openable at an overlapped portion 15, at which opposite end portions of the belt portion are releasably fastened together by a button 17. In the area around the beginning end 16 of the slide fastener 12 the cloth material is formed with free upper edges 19 by cutting of the cloth material forming the trousers along the lower edge of the belt portion 14, such that when the opener 22 is pulled down from the beginning point 16, the opening formed by the slide fastener is more widely expanded on opposite sides at a portion of the free upper edge 19. 29 is a piece of cloth connected to one of the opposite ends of the belt portion 14 along a lower edge thereof so as to be patched on to the cloth material constructing the trousers from the inside thereof to lie behind the free upper edge 19.

Figure 7:
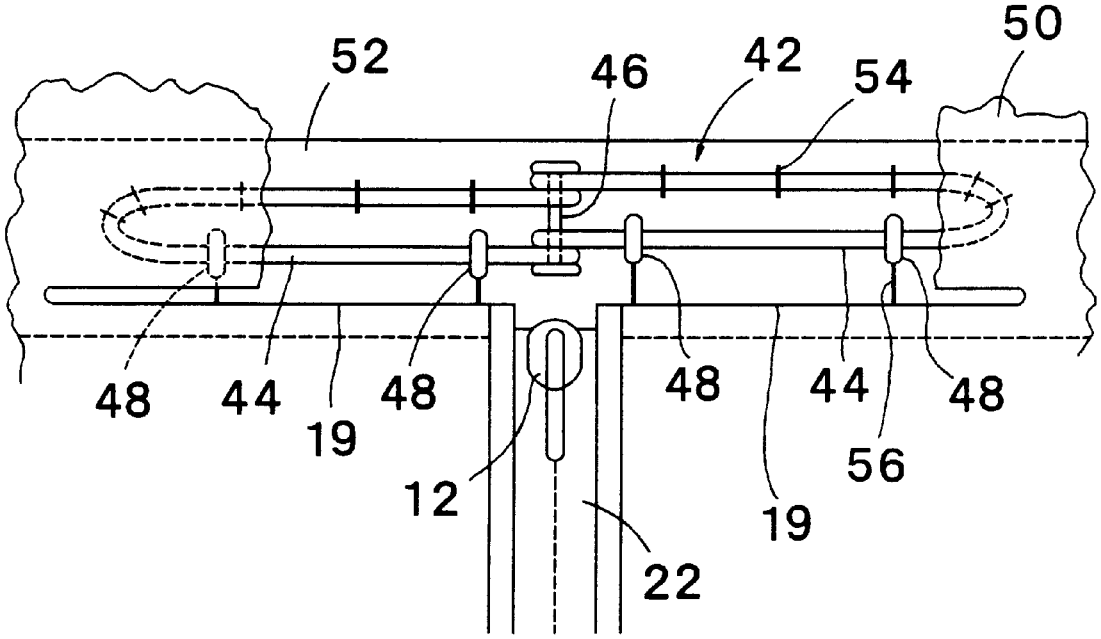
FIG. 7 is an enlarged partial rear view around the first end of the slide fastener, showing an embodiment incorporating a guide rail means for slidably supporting free upper edge portions of the cloth material forming the trousers or the combination wear, with a part of the cloth material being broken away for the purpose of illustration.

FIG. 7 is an enlarged partial rear view around the beginning point 16 of the slide fastener of the trousers shown in FIG. 6, showing an embodiment incorporating a guide rail means 42 for slidably supporting the free upper edge 19 of the cloth material forming the trousers or the combination wear, with a part of the cloth material being broken away for the purpose of illustration. The guide rail means 42 includes a pair of U-shaped wire elements 44 connected with one another at an open end of the U-shape thereof by a hinge pin 46 to be foldable therealong, and a plurality of slide elements 48 (four in the shown embodiment) slidably supported by a lower one of a pair of leg portions of the U-shaped wire element 44. An upper leg portion of each of the U-shaped wire elements 44 is fastened to the cloth material 50 forming the trousers, particularly a reinforcing strip material 52 attached to the cloth material 50 by thread, a part of which is designated by 54, while the slide elements 48 are connected with the free upper edges 19 by thread, another part of which is also designated by 56, such that the pair of free upper edges 19 are each supported by each half of the plurality of slide elements 48.

By the free upper edges 19 of the cloth material 50 defining the beginning point 16 of the slide fastener 12 being supported by the guide rail means 42, the opening action applied to the slide opener 22 is definitely reacted by a supporting force so as to ensure an easy opening of the slide fastener 12. When the slide fastener 12 is opened, the free upper edges 19 are readily movable to depart from one another, so as thereby easily to provide a wide opening along the root portion of the trousers.

Figure 4:
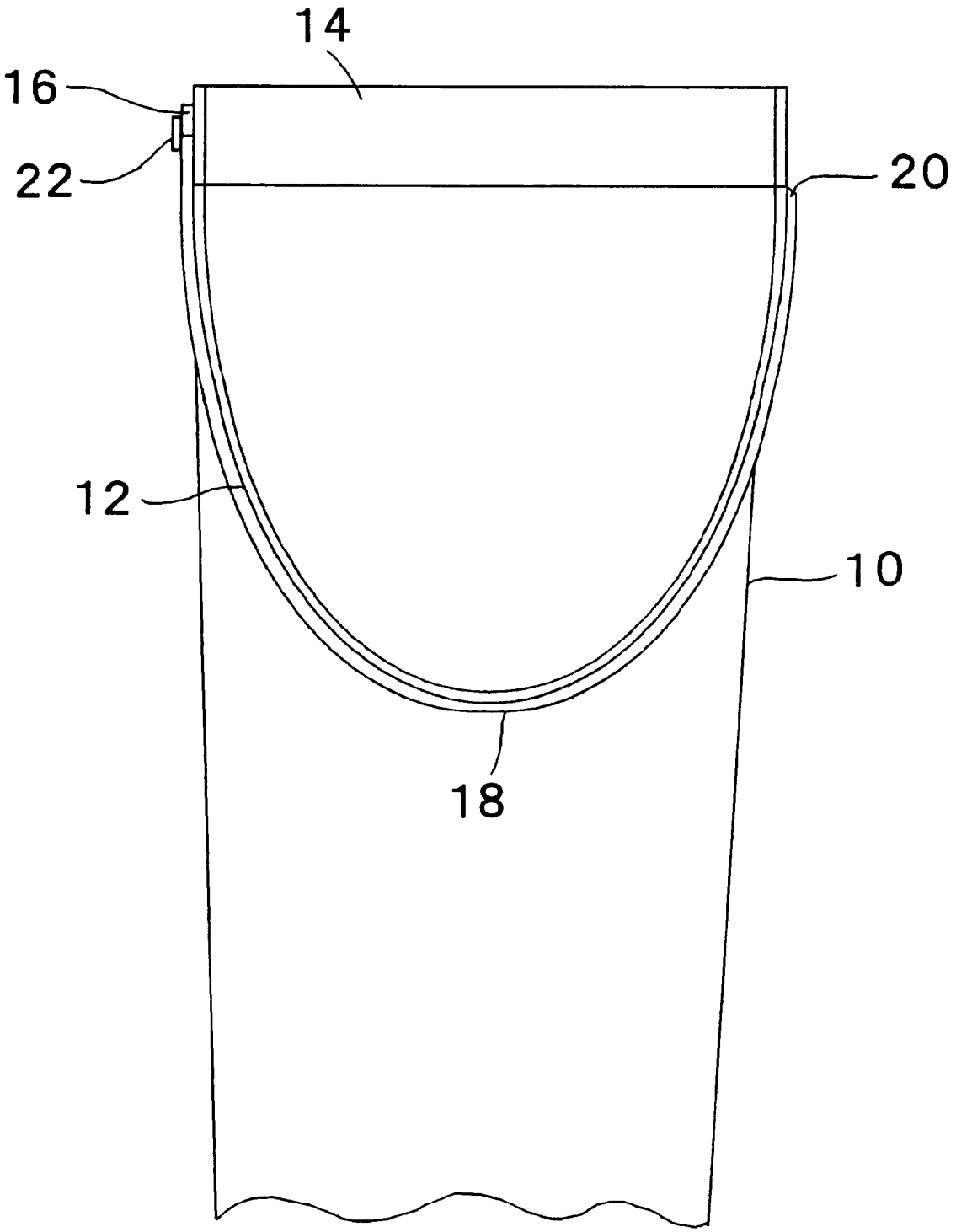
FIG. 4 is a sectional view along line IV—IV in FIG. 2.
Figure 8:
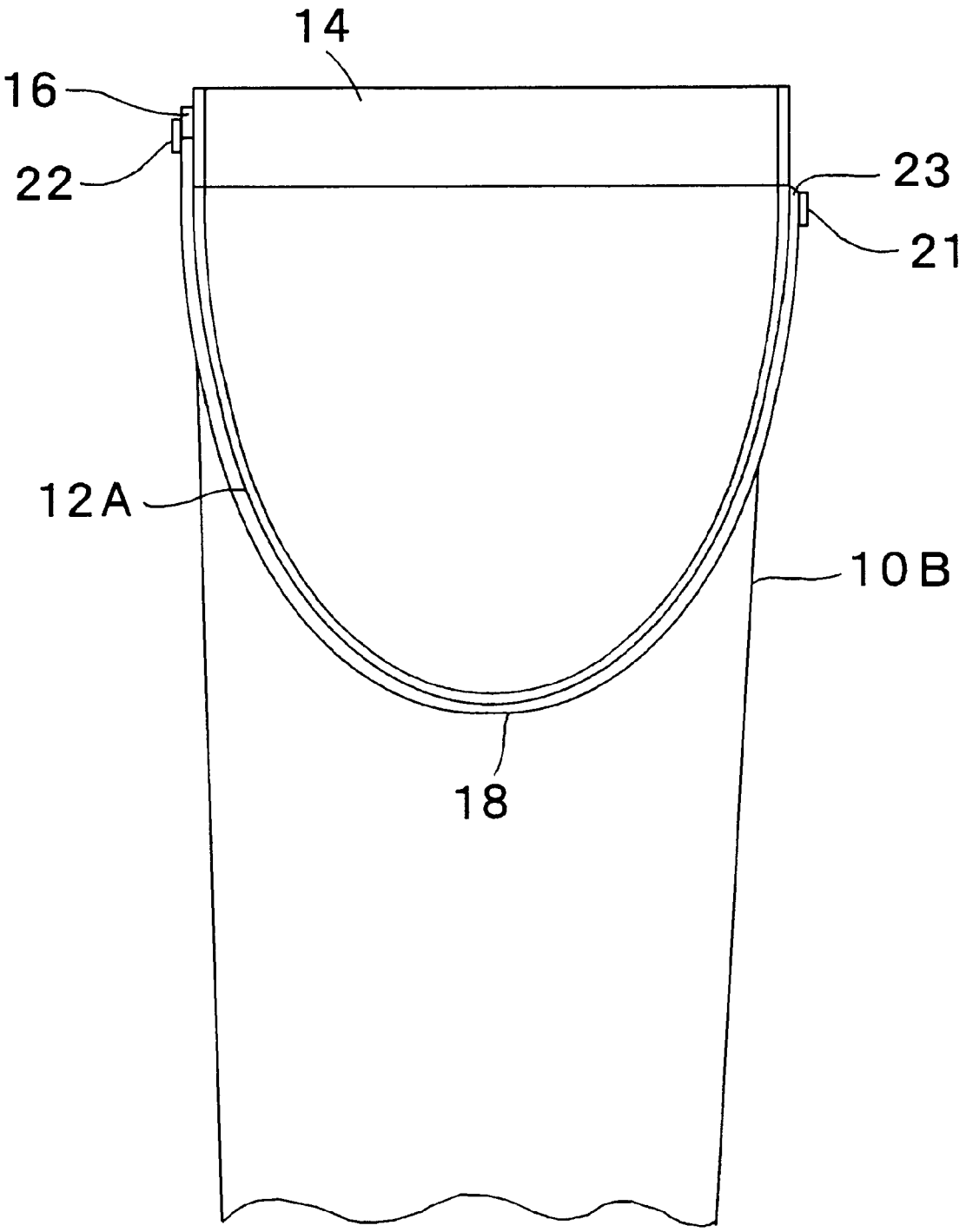
FIG. 8 is a longitudinal sectional view of an upper half portion of still another embodiment of the trousers according to the present invention.

FIG. 8 is a longitudinal sectional view similar to FIG. 4, showing still another embodiment of the trousers according to the present invention, partly modified from the embodiment shown in FIGS. 1–5. In the trousers 10B shown in FIG. 8, the portions corresponding to those shown in FIG. 4 are designated by the same reference numerals in FIG. 4. In this embodiment, the slide fastener 12A is a double slide fastener openable by the opener 22 starting from the beginning point 16 positioned around the back upper edge of the trousers and also openable by another opener 21 starting from another beginning point 23 positioned around a front upper edge of the trousers. The belt portion 14 may designed to be openable at the front center position as usual in the conventional trousers, though not shown in the figure. By the slide fastener 12A having those two openers and being openable from opposite ends thereof, the trousers 10B is openable along the root portion thereof in the same manner as the trousers 10 shown in FIGS. 1–5 starting from the beginning point 16 positioned around the back upper edge thereof toward the front upper edge through the bottom of the root portion on the one hand, while on the other hand the trousers are openable by the opener 21 starting from the beginning point 23 positioned around the front upper edge toward the back upper edge through the bottom of the root portion. This embodiment is particularly convenient for male wearers.

Figure 9:
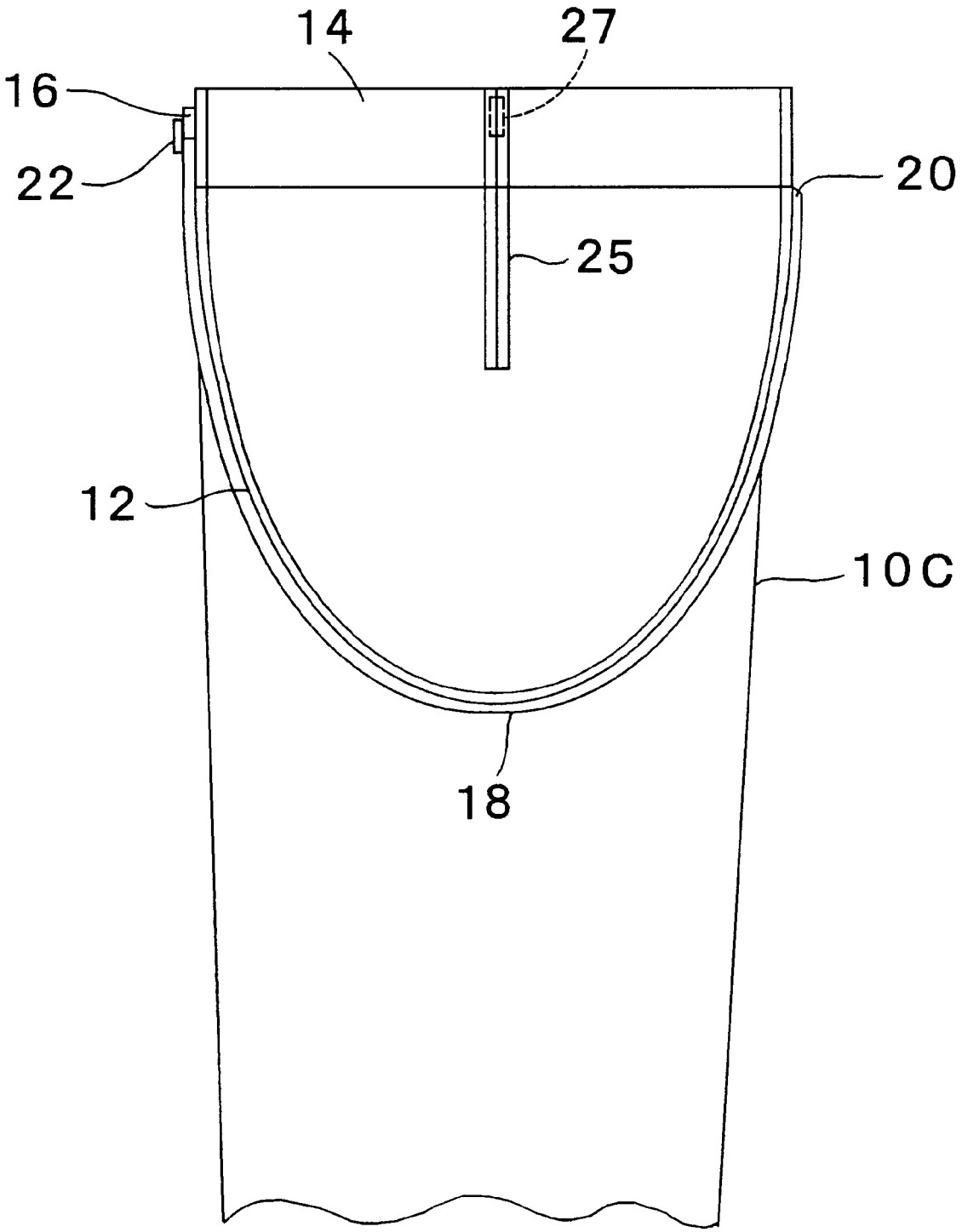
FIG. 9 is a longitudinal sectional view of an upper half portion of still another embodiment of the trousers according to the present invention.

FIG. 9 is a longitudinal sectional view similar to FIG. 4, showing still another embodiment of the trousers according to the present invention, partly modified from the embodiment shown in FIGS. 1–5. In FIG. 9, the portions corresponding to those shown in FIG. 4 are designated by the same reference numerals. In the trousers 10C shown in FIG. 9, opposite side upper edge portions thereof are each provided with an openable portion incorporating a slide fastener 25 extending vertically along a center of each side portion. 27 is an opener of the slide fastener 25. By such side opening portions being provided to be openable by the slide fasteners 25, the belt portion 14 can be more widely loosened for higher easiness of putting on and off of the trousers, even when the trousers are not openable at the front upper edge portion. It will be apparent that the modification of FIG. 8 may also be incorporated into the embodiments shown in FIGS. 6 and 8.

Figure 10:
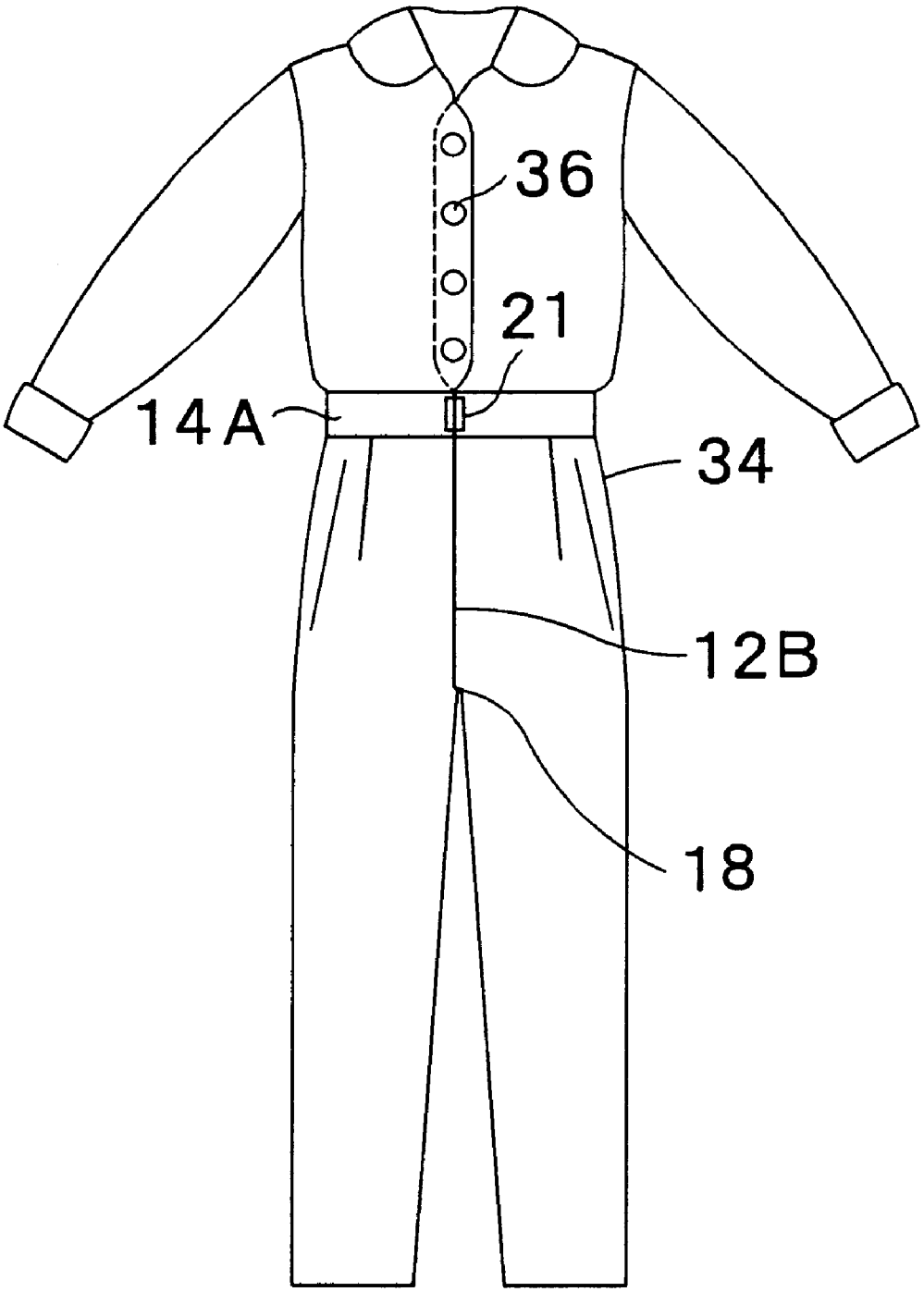
FIG. 10 is a front view showing an embodiment of the combination wear according to the present invention.
Figure 11:
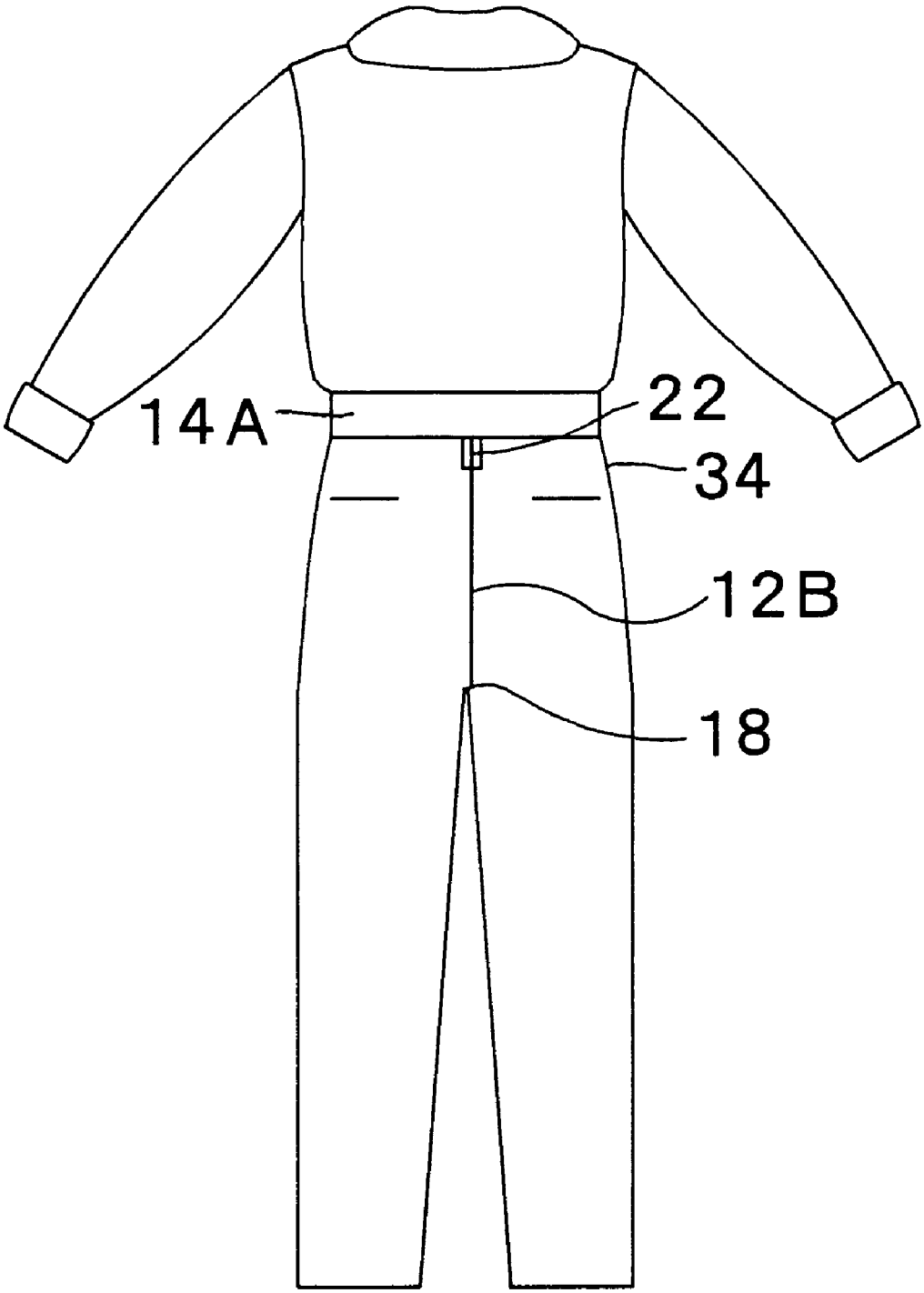
FIG. 11 is a rear view of the combination wear shown in FIG. 10.

FIG. 10 is a front view showing an embodiment of the combination wear according to the present invention, and FIG. 11 is a rear view of the combination wear shown in FIG. 10. In FIGS. 10 and 11, the portions corresponding to those shown in FIGS. 1–5 are designated by the same reference numerals. In the combination wear 34 of this embodiment, the slide fastener designated by 12B is a double slide fastener openable from a beginning point positioned around a back lower edge of the belt portion 14A as well as another beginning point positioned around a front upper edge of the belt portion 14A, traversing the belt portion 14A. The upper garment portion is longitudinally openable at the front center along overlapped edge portions releasably fastened by a plurality of buttons 36.

Figure 12:
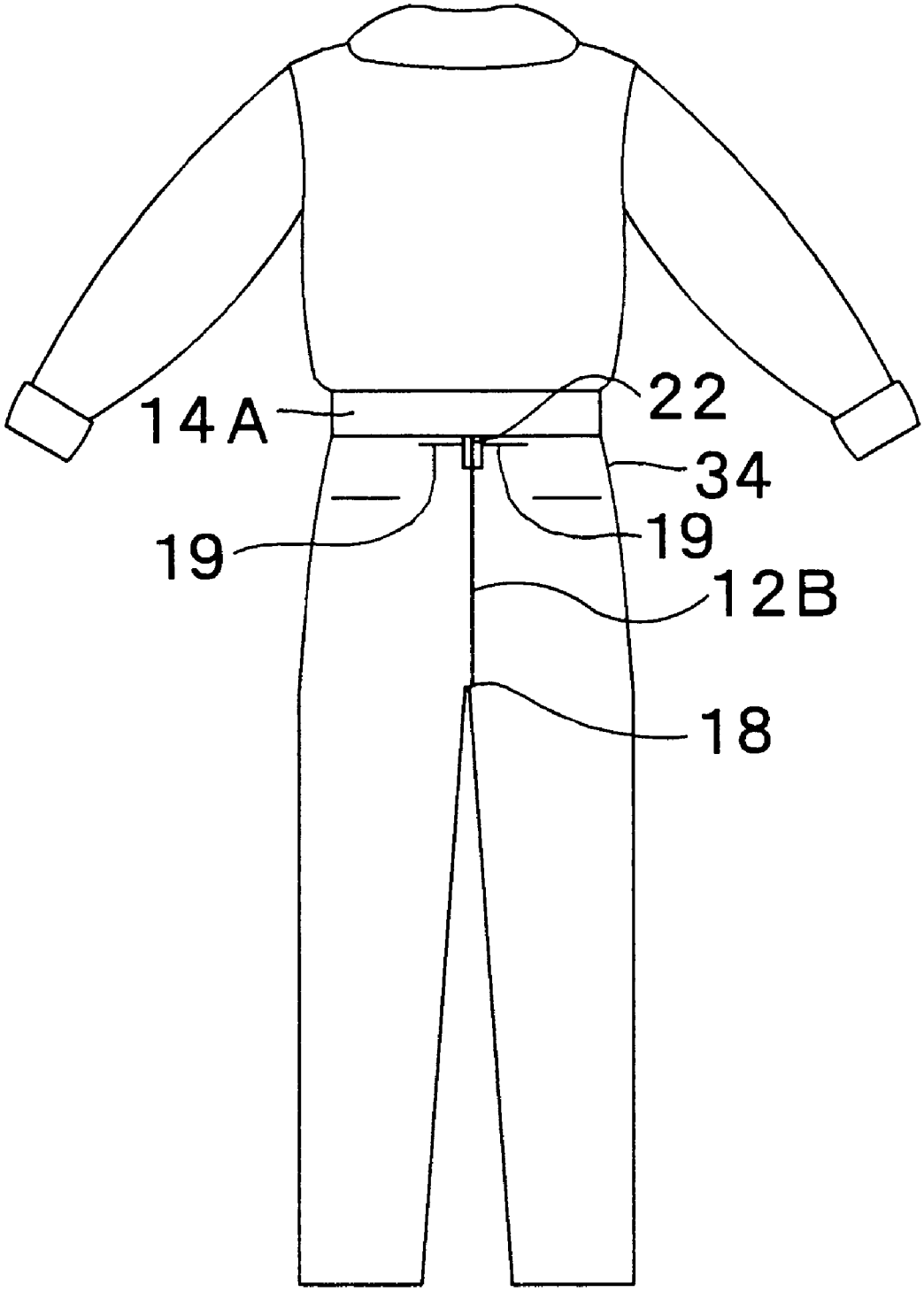
FIG. 12 is a view similar to FIG. 11, showing a modification that the free upper edge portions are formed around the beginning end of the slide fastener.

FIG. 12 is a front view similar to FIG. 11, showing a modification that a pair of free upper edges 19 of the same constriction as that shown in FIG. 6 or 7 are provided at the same portion. It will be appreciated that the provision of the free upper edges 19 in the combination wear also provides a better convenience for opening the root portion of the combination wear.

Figure 13:
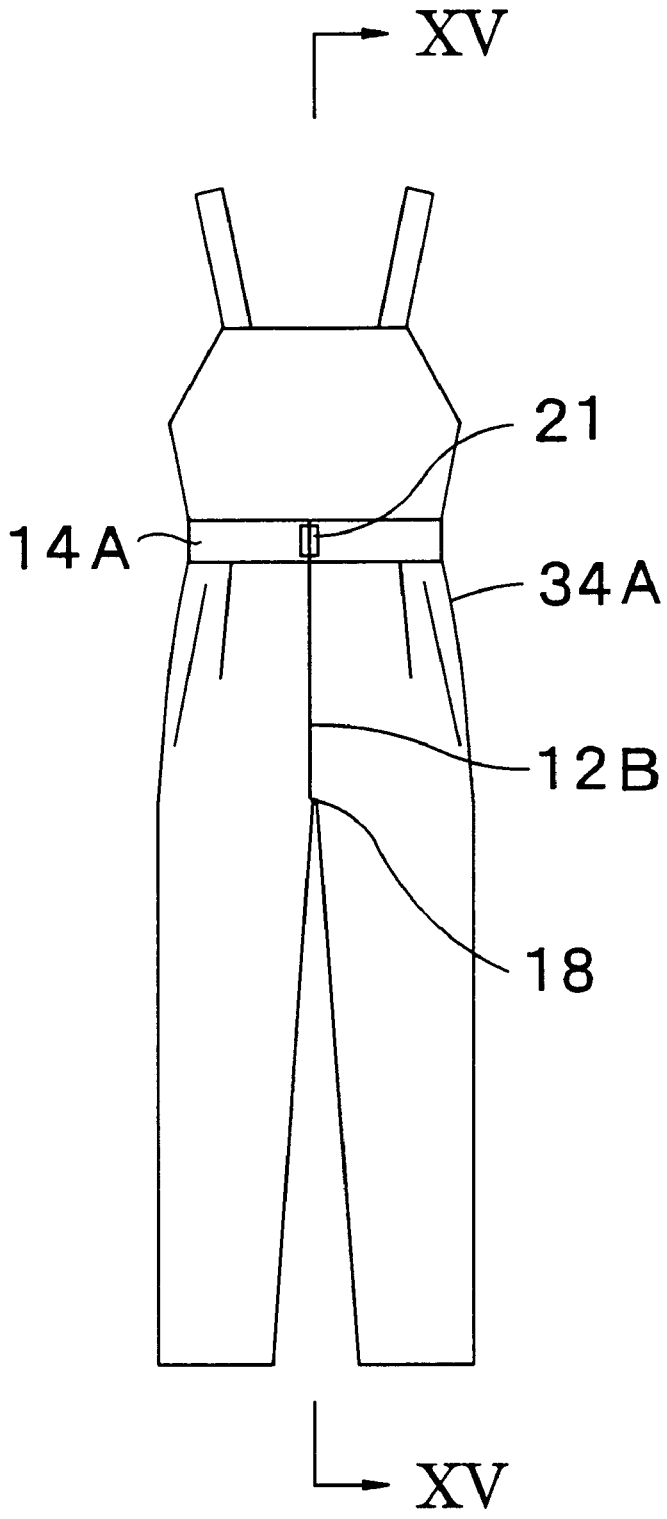
FIG. 13 is a front view showing another embodiment of the combination wear according to the present invention.
Figure 14:
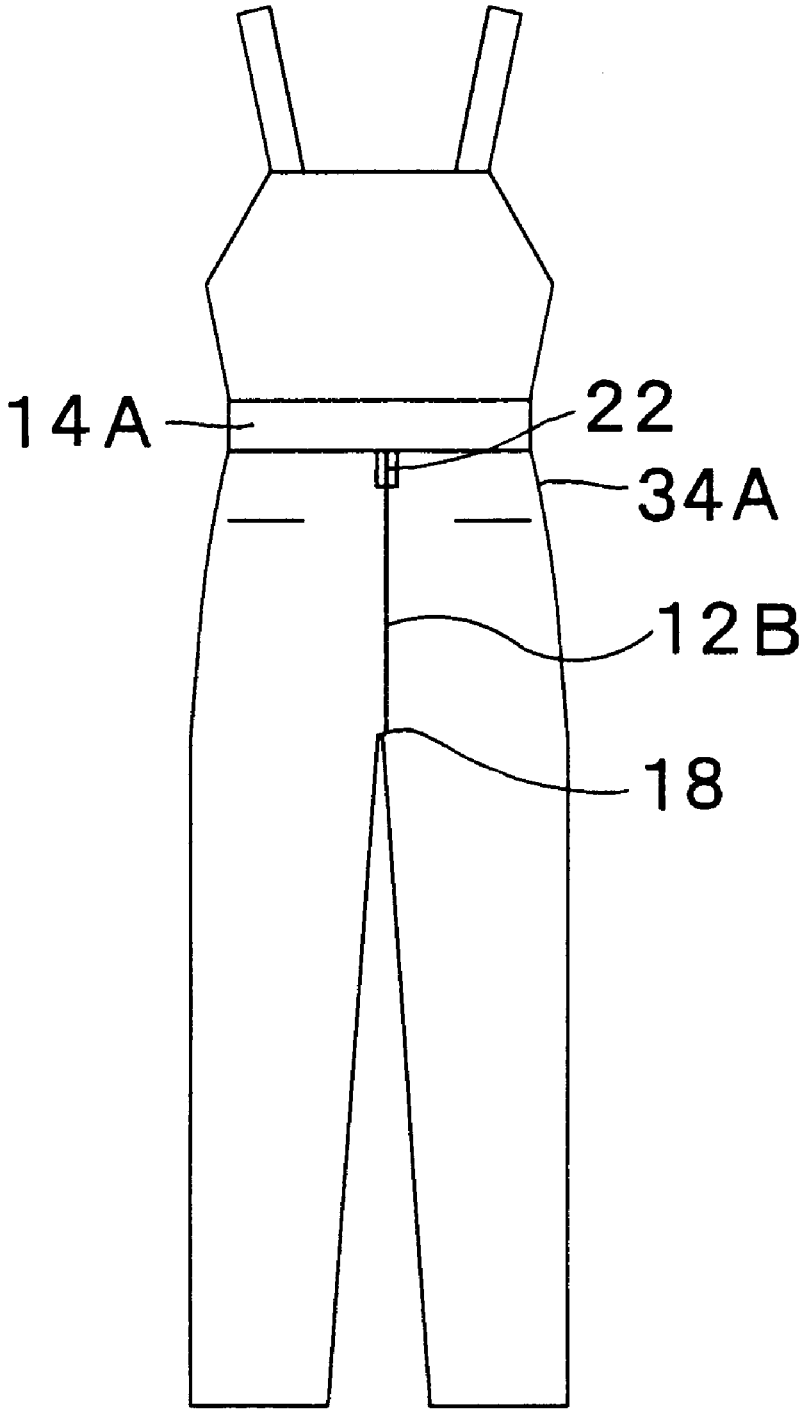
FIG. 14 is a rear view of the combination wear shown in FIG. 13.
Figure 15:
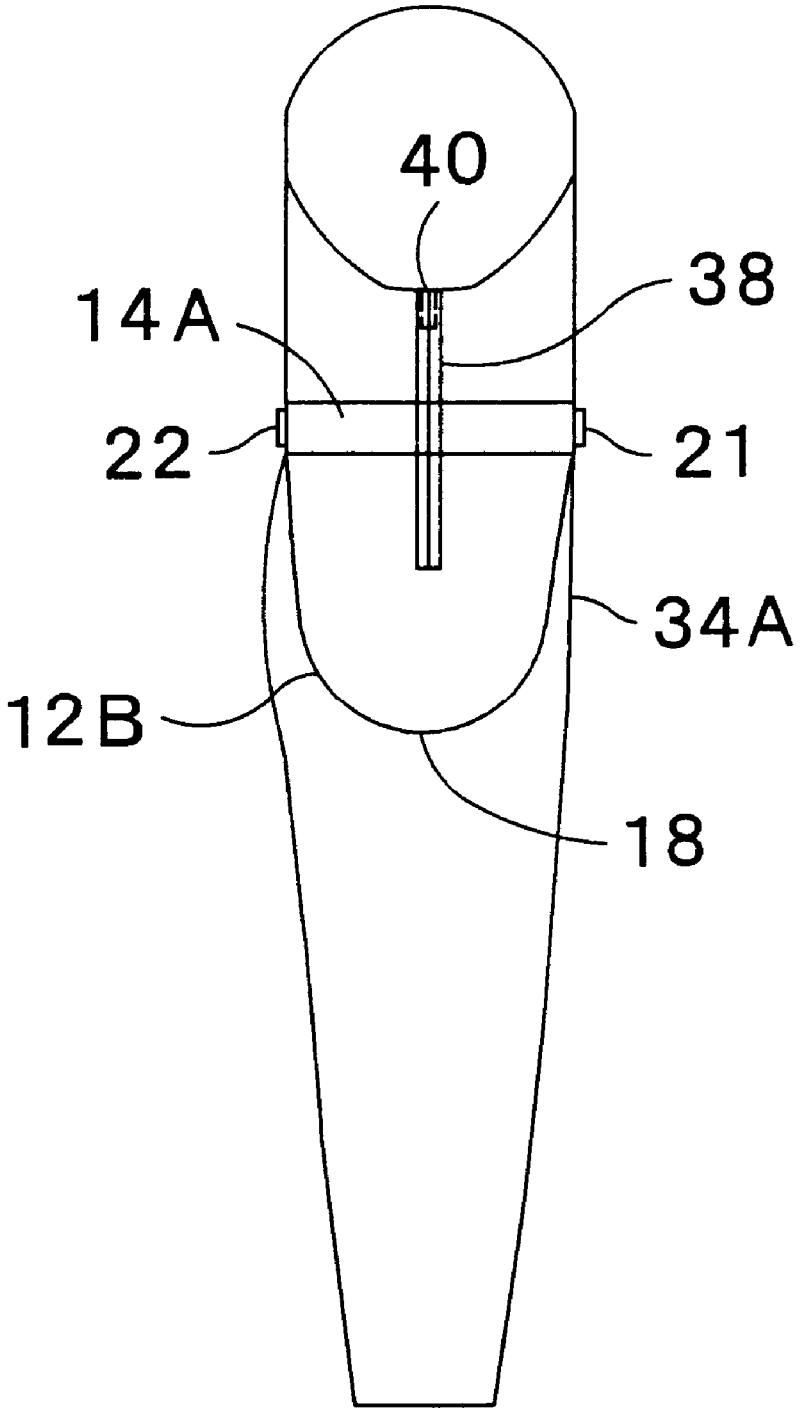
FIG. 15 is a longitudinal sectional view along line XV—XV in FIG. 11.

FIG. 13 is a front view showing still another embodiment of the combination wear according to the present invention, and FIG. 14 is a rear view thereof. FIG. 15 is a longitudinal sectional view along line XV—XV in FIG. 13. In FIGS. 13–15, the portions corresponding to those shown in FIGS. 10 and 11 are designated by the same reference numerals as in FIGS. 10 and 11. As shown in FIGS. 13–15, the combination wear 34A has no sleeves in its upper half portion in contrast to the combination wear 34 shown in FIGS. 10 and 11, and there is no opening structure incorporated along a longitudinal center of the upper half portion. Instead, at opposite sides through waist and chest portions, there are provided a pair of openable portions by slide fasteners 38 openable from each upper end thereof toward downward through the chest and waist portions across the belt portion 14A. 40 designates an opener of the slide fasteners 38. By the opposite side portions being opened by the slide fasteners 38, the putting on and off of this combination wear is facilitated without any openable portion being provided in the front portion of the upper half portion.

Although the present invention has been described in detail with respect to some preferred embodiment thereof, it will be apparent for those skill in the art that various other embodiments are possible within the scope of the present invention.

I claim:

1. Trousers openable at a root portion thereof along a U-shaped center line thereof by a slide fastener starting from a first end thereof positioned around a back upper edge thereof to a second end thereof positioned around a front upper edge thereof through a lowest point of the U-shaped center line, wherein an upper edge portion of the trousers is defined by a belt portion, said first end of the slide fastener being positioned adjacent to a lower edge of the belt portion, with a cloth material forming the trousers defining a pair of free upper edge portions extending along the lower edge of the belt portion on opposite sides of said first end of the slide fastener, such that the trousers are widely openable at the back upper edge thereof with the free upper edge portions being released from one another by the slide fastener being opened at least at and in an area adjacent to said first end thereof.

2. Trousers according to claim 1, wherein said slide fastener is a double slide fastener openable from both of said first and second ends by a first and a second opener, respectively, such that when said second opener is positioned at said second end, the root portion is openable along the U-shaped center line starting from said first end toward said second end through the lowest point of the U-shaped center line by said first opener, while when said first opener is positioned at said first end, the root portion is openable along the U-shaped center line starting from said second end toward said first end through the lowest point of the U-shaped center line by said second opener.

3. Trousers according to claim 1, wherein said pair of free upper edge portions of the cloth material are formed by the cloth material being transversely cut to form a pair of slits on opposite sides of said first end of the slide fastener along the lower edge of the belt portion.

4. Trousers according to claim 1, further comprising a guide rail means arranged to extend along the belt portion in an area above said first end of the slide fastener and a plurality of slide elements supported by the guide rail means to be slidable therealong, wherein the free upper edge portions are each connected with each half of the plurality of slide elements such that the free upper edge portions are each separately supported by the guide rail means to be movable therealong in opposite directions.

5. Trousers according to claim 4, wherein the guide rail means incorporates therein a hinge means at a transversely central portion thereof so as to be foldable therealong.

6. Trousers according to claim 5, wherein the guide rail means comprises a pair of U-shaped wire elements connected with one another at an open end of the U-shape thereof by the hinge means to be foldable therealong, the U-shaped wire elements each slidably supporting each half of the plurality of slide elements at one of leg portions thereof, while being fastened to the cloth material at another of the leg portions.

7. Trousers according to claim 1, wherein the belt portion has an overlapped portion around a back central portion thereof corresponding to the back upper edge of the trousers where opposite ends of the belt portion are laid one over the other and normally fastened by a releasable fastening means.

8. Trousers according to claim 7, wherein a piece of cloth is provided along the belt portion as connected to one of said opposite ends of the belt portion laid inside of the other of said overlapped opposite ends to be patched on to the cloth material forming the trousers from an inside thereof to lie behind the free upper edge portions.

9. Trousers according to claim 1, wherein a pair of openable portions are provided at opposite side portions thereof each to be openable by a slide fastener starting from a side upper edge thereof.

10. A combination wear including an upper wear portion and a trouser portion integral with one another, the trouser portion being openable at a root portion thereof along a U-shaped center line thereof by a slide fastener starting from a first end thereof positioned around a back upper edge thereof to a second end thereof positioned around a front upper edge thereof through a lowest point of the U-shaped center line, wherein a belt portion is provided along a border between the upper wear portion and the trouser portion, said first end of the slide fastener being positioned adjacent to a lower edge of the belt portion, with a cloth material forming the combination wear defining a pair of free upper edge portions of the trouser portion extending along the lower edge of the belt portion on opposite sides of said first end of the slide fastener, such that the trouser portion is widely openable at the back upper edge thereof with the free upper edge portions being released from one another by the slide fastener being opened at least at and in an area adjacent to said first end thereof.

11. A combination wear according to claim 10, wherein said slide fastener is a double slide fastener openable from both of said first and second ends by a first and a second opener, respectively, such that when said second opener is positioned at said second end, the root portion is openable along the U-shaped center line starting from said first end toward said second end through the lowest point of the U-shaped center line by said first opener, while when said first opener is positioned at said first end, the root portion is openable along the U-shaped center line starting from said second end toward said first end through the lowest point of the U-shaped center line by said second opener.

12. A combination wear according to claim 10, wherein said pair of free upper edge portions of the cloth material are formed by the cloth material being transversely cut to form a pair of slits on opposite sides of said first end along the lower edge of the belt portion.

13. A combination wear according to claim 11, further comprising a guide rail means arranged to extend along the belt portion in an area above said first end of the slide fastener and a plurality of slide elements supported by the guide rail means to be slidable therealong, wherein the free upper edge portions are each connected with each half of the plurality of slide elements such that the free upper edge portions are each separately supported by the guide rail means to be movable therealong in opposite directions.

14. A combination wear according to claim 10, wherein said upper wear portion is an upper garment portion having a pair of sleeve portions and openable along a front vertical center line thereof, while the trouser portion is openable till a front upper edge thereof, so that the combination wear is totally openable from a back point positioned between the upper garment portion and the trouser portion to a front upper edge of the upper garment portion through the lowest point of the U-shaped center line.

15. A combination wear according to claim 10, wherein said upper wear portion is sleeveless, leaving opposite side portions, the side portions each being vertically openable by a slide fastener starting from an upper edge thereof.

* * * * *